United States Patent [19]

Esaki et al.

[11] 3,970,187

[45] July 20, 1976

[54] SAFETY DEVICE FOR PASSENGER CONVEYOR

[75] Inventors: Shigeru Esaki; Shigeru Murata; Matsuhiko Ishida; Katsumi Kito, all of Inazawa, Japan

[73] Assignee: Mitsubishi Denki Kabushiki Kaisha, Japan

[22] Filed: Nov. 11, 1974

[21] Appl. No.: 522,891

[30] Foreign Application Priority Data

Nov. 12, 1973 Japan ..... 48-130606[U]
Nov. 19, 1973 Japan ..... 48-133996[U]

[52] U.S. Cl. ..... 198/16 R; 104/25
[51] Int. Cl.[2] ..... B66B 9/12
[58] Field of Search ..... 198/16 R, 16 MS; 104/25, 18, 20

[56] References Cited

UNITED STATES PATENTS

| | | | |
|---|---|---|---|
| 2,080,980 | 5/1937 | Fiedler | 198/16 R |
| 2,550,918 | 5/1951 | Felix et al. | 198/16 R |
| 2,708,997 | 5/1955 | Durang et al. | 198/16 R |
| 2,846,045 | 8/1958 | Fowler | 198/16 R |
| 3,809,206 | 5/1974 | Bredehorn et al. | 198/16 R |

*Primary Examiner*—Robert J. Spar
*Assistant Examiner*—James M. Slattery
*Attorney, Agent, or Firm*—Robert E. Burns; Emmanuel J. Lobato; Bruce L. Adams

[57] ABSTRACT

The disclosed safety device includes a barrier member disposed on a departure landing in front of a guide port for receiving a moving handrail after having been turned in its traveling direction. The barrier member is provided on the upper surface with a C-shaped groove having an opening narrower than the width of the handrail and formed of two sections of easily destructable material divided in a plane extending lengthwise of the groove. The handrail is loosely inserted into the groove. The barrier member may be provided on each of its lateral side surfaces with a notch in the form of a semi-arch.

4 Claims, 11 Drawing Figures

SAFETY DEVICE FOR PASSENGER CONVEYOR

BACKGROUND OF THE INVENTION

This invention relates to improvements in a safety device for a balustrade of a passenger conveyor such as an escalator, a moving footway or the like disposed on a guide port thereof through which a moving handrail involved enters the interior of the mechanical portion of the passenger conveyor.

In order to prevent one portion of a cloth of any person or his or her finger from being pulled into a guide port of the type referred to, it has been previously practiced to dispose a barrier member in front of the guide port on the associated leaving landing. The barrier member has been generally formed into a box approximating a cube of a material capable of being easily broken with a very low pressure, for example, foamed polystyrene. The barrier member serves as a safety device. If any person has one portion of his or her cloth or his or her finger pulled into a gap formed between the barrier member and the adjacent portion of the moving handrail then the barrier member can readily be broken with the resulting pressure to sound and scatter. Thus the person tends to surprisedly jump back or aside or to retract his or her finger. At that time the barrier member has already scattered and therefore this retracting operation can be performed without any hindrance. In this way the person has been able to be prevented from undergoing serious accidents of the human body.

Also if any person falls down on the floor adjacent a departure landing of an escalator to tend to be partly pulled into a gap between the landing and that portion of the associated moving handrail turned in its traveling direction then that portion of his or her body tending to by pulled into the gap is blocked by the barrier member thereby to be prevented from being caught by the turned portion of the moving handrail.

However, in order to facilitate the installation thereof, conventional barrier members have been shaped to form the gap between the same and the mated parts sufficient to permit a passenger's finger to be readily pulled thereinto. Further since passengers go past the departure landing for the escalator, the provision of the barrier member in the form of a box approximating a cube on the landing might cause a danger that some of the persons would fall down on the landing because they stumble over the barrier member. At that time the barrier member might be broken. This has led to an objection that the safety device would have been broken for reasons other than those proper therefor.

SUMMARY OF THE INVENTION

Accordingly it is an object of the present invention to provide a safety device for a balustrade of a passenger conveyor including an improved barrier member constructed so that a finger of any passenger is prevented from being pulled into a gap around the barrier member while the passenger does not stumble over the latter.

The present invention accomplishes this object by the provision of a safety device or guard for a balustrade of a passenger conveyor including a moving handrail traveling around the periphery of the balustrade to be turned in the traveling direction thereof on a departure landing, and a guide port for introducing the moving handrail into the mechanical portion of the passenger conveyor, the safety device comprising a barrier member disposed in front of the guide port and formed of a material capable of being easily broken with a very low pressure, and a groove disposed on the barrier member to have an opening narrower than the width of the moving handrail, and an inner portion dimensioned to receive the moving handrail loosely therein, the barrier member being formed of at least two barrier sections divided in a sectional plane extending lengthwise of the groove and reaching the groove, said barrier sections being connected together into a unitary structure.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
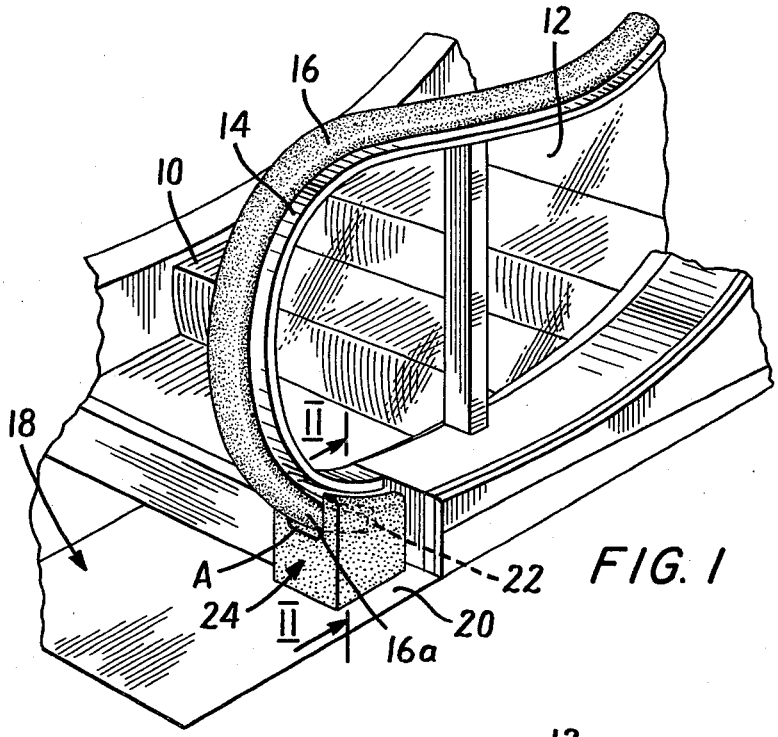
FIG. 1 is a fragmental perspective view of an escalator provided with a conventional safety device for a balustrade involved with parts broken away.

Referring now to the drawings and FIG. 1 in particular, there is illustrated an escalator including a conventional safety device for a balustrade involved. The arrangement illustrated comprises a plurality of treads 10 in the form of a stairway moving in a predetermined direction, in this case, in the down direction and at a predetermined fixed speed, and a pair of balustrades disposed in spaced parallel relationship on both sides of the stairway and including glass panels 12. Only the balustrade on the viewer's side is illustrated for purposes of clarity of illustration. Each balustrade has its upper edge and both end portions defined by a frame 14 which, in turn, guides a moving handrail 16 therealong to travel in the same direction at the same speed as the treads 10. The handrail 16 is turned in its traveling direction adjacent a departure landing 18 on a floor 20 and then introduced into the mechanical portion of the escalator through a guide port 22.

In order to prevent any passenger's clothing, finger or the like from being pulled into the guide port 22, it has been previously practiced to dispose a barrier member generally designated by the reference numeral 24 on the departure landing 18 in front of the guide port 22. The barrier member 24 has been formed into a box approximating a cube of a material capable of being easily broken with a very low pressure for example, foamed polystyrene. The barrier member 24 has served as a safety device. If a passenger's clothing or finger tends to be pulled into a gap A formed between the turned portion 16*a* of the moving handrail 16 and the barrier member 24 then the barrier member 24 can easily be broken with the resulting low pressure to sound and scatter. Thus the passenger tends to surprisedly jump back or aside or to retract his or her finger. At that time the barrier member has already scattered and therefore this retracting operation can be performed without any hindrance. In this way any serious accident of the human body is prevented from happening to the passenger.

Also if any person falls down on the floor 20 adjacent to the departure landing 18 for the escalator to tend to be partly pulled into the gap between the turned portion 16*a* of the moving handrail 16 and the landing 18 then that portion of his or her body tending to be pulled into this gap is blocked by the barrier member 24 thereby to be prevented from being caught by the turned portion 16*a* of the moving handrail 16.

Figure 2:
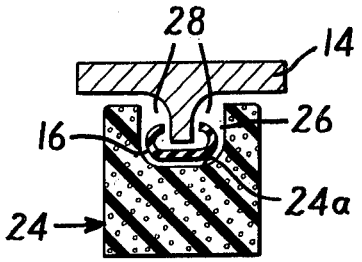
FIG. 2 is a sectional view taken along the line II—II of FIG. 1.

However, in order to facilitate the installation thereof, conventional barrier members have been constructed such as shown in FIG. 2 so that the U-shaped groove 26 is disposed on that surface thereof opposing the frame 14 or the upper surface 24*a* as viewed in FIG. 2 to form a passageway along which the handrail 16 travels. With such a grooved barrier member 24 operatively associated with the handrail 16 having a C-shaped cross section, a relatively broad space 28 is formed on the upper portion of the front surface of the barrier member 24. This has resulted in a disadvantage in that a finger or fingers of any person is or are easily pulled into the space 28.

Figure 3:
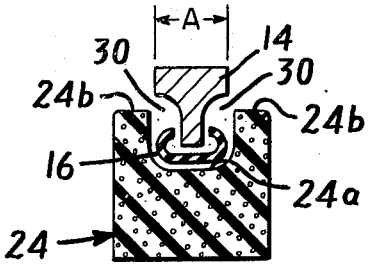
FIG. 3 is a view similar to FIG. 2 but illustrating a modification of the arrangement shown in FIG. 2.

With the grooved barrier member 24 installed on an escalator with transparent balustrades, a space 30 is also formed between the upper surface 24*b* of the barrier member 24 and the associated frame 14 as shown in FIG. 3. This is because the frame 14 is narrow in width A. This has led to the same disadvantage as above described in conjunction with FIG. 2.

Further since persons go past the departure landing 18, the disposal of the barrier member 24 in the form of a box approximating a cube on the landing might lead to a danger that some of the persons would fall down on the landing because they stumble over the barrier member. At that time, the barrier member might be broken. This has resulted in an objection that the safety device would have been broken for reasons other than those proper therefor.

The present invention contemplates to eliminate the disadvantages of and objection to the prior art practice as above described.

Figure 4:
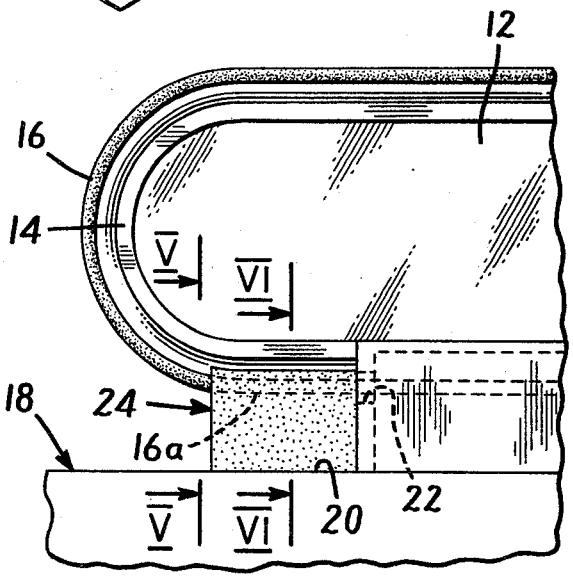
FIG. 4 is a fragmental side elevational view of a passenger conveyor including a safety device constructed in accordance with the principles of the present invention.
Figure 6:
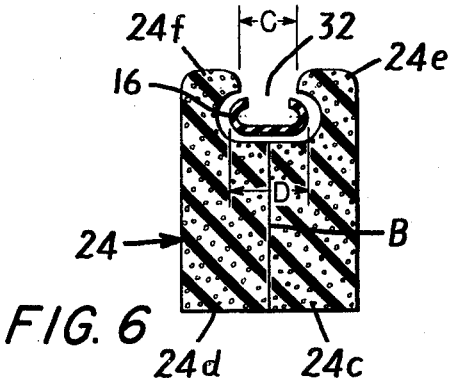
FIG. 6 is a sectional view taken along the line VI—VI of FIG. 4.

Referring now to FIG. 4 there is illustrated a passenger conveyor embodying the principles of the present invention. In FIG. 4 et seqq. like reference numerals designate the components identical or similar to those shown in FIGS. 1 through 3. As in the arrangement of FIG. 1, the moving handrail 16 is introduced into the mechanical portion of the passenger conveyor through a grooved barrier member 24 and a guide port 22. The barrier member 24 is also formed of a material capable of being easily broken with a very low pressure. As best shown in FIG. 6, the barrier member 24 is formed of a pair of barrier section 24*c* and 24*d* each being a mirror image of the other section with respect to the central longitudinal plane B of the barrier member 24 in which both barrier sections are connected together into a unitary structure. The barrier sections 24*c* and 24*d* have respective upwardly projecting portions 24*e* and 24*f* which, in their assembled position bilaterally embrace the moving handrail 16 lengthwise thereof while a narrow clearance is left therebetween. The free ends of the projecting portions 24*e* and 24*f* somewhat extend toward each other to form an opening having a spacing C smaller than the width D of the handrail 16. Thus the projecting portions 24*e* and 24*f* in their assembled position form a C-shaped groove 32 in the upper portion of the barrier member 24.

Figure 5:
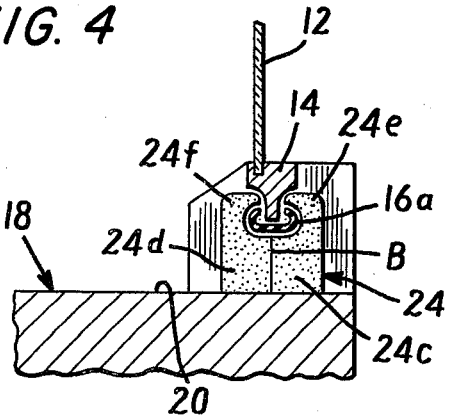
FIG. 5 is a sectional view taken along the line V—V of FIG. 4.

Upon assembling the barrier member 24, the barrier sections 24*c* and 24*d* are disposed in front of the guide port 22 on the departure landing 18 to bilaterally embrace the turned handrail 16*a* and then connected together into a unitary structure along the junction plane B by any desired means. The barrier member 24 thus assembled is suitably fixed on the floor 20 or the like as shown in FIG. 5. In this way the moving handrail 16 is inserted into the C-shaped groove 32 with a narrow clearance maintained therebetween. Since the projecting portions 26*e* and 26*d* sufficiently embrace the handrail 16 as shown in FIG. 6, the space 28 or 30 shown in FIGS. 2 or 3 is not formed. Therefore a possibility that a person's finger or fingers will be pulled into a gap around the barrier member 24 becomes less.

Figure 7:
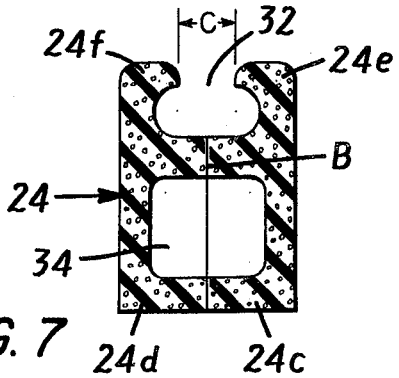
FIGS. 7 and 8 are sectional views of different modifications of the arrangement shown in FIG. 4.

An arrangement as shown in FIG. 7 is substantially identical to that shown in FIGS. 5 and 6 except that the barrier sections 24*c* and 24*d* are provided on the lower portions with a pair of opposite hollow portions 34 in order to save the material thereof.

Figure 8:
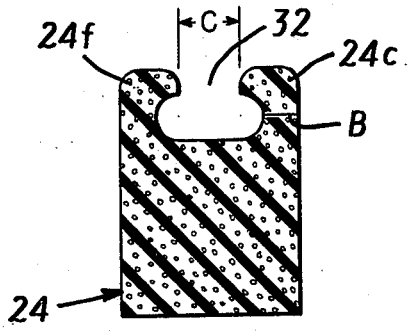

FIG. 8 shows an arrangement different from that illustrated in FIGS. 5 and 6 only in that the junction plane B is disposed in either one of the projecting portions in this case, the righthand portion 24*e* to reach the corresponding inner lateral surface of groove 32.

Figure 9:
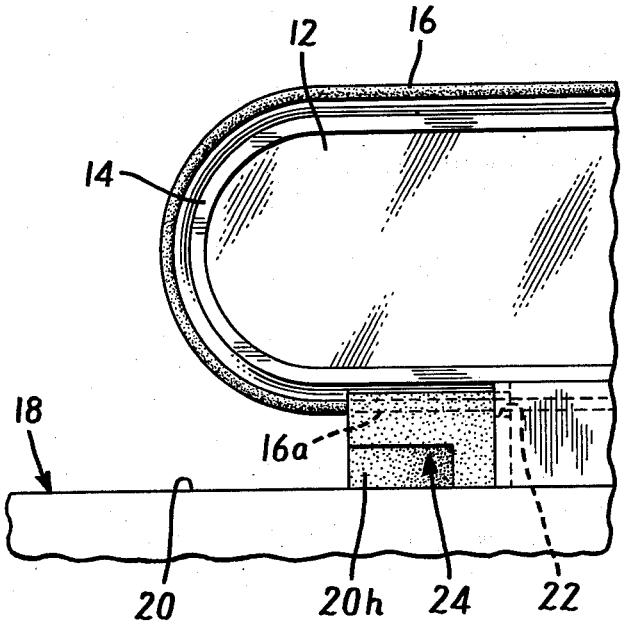
FIG. 9 is a view similar to FIG. 4 but illustrating another modification of the present invention.
Figure 10:
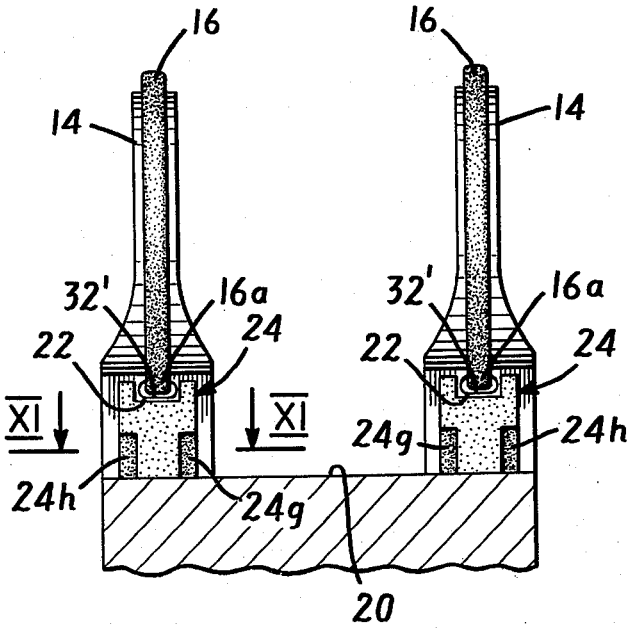
FIG. 10 is a front elevational view of the arrangement shown in FIG. 9.
Figure 11:
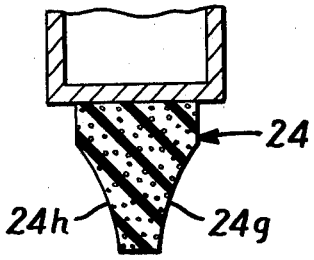
FIG. 11 is a sectional view taken along the line XI—XI of FIG. 10.

In a passenger conveyor as shown in FIGS. 9 through 11, the barrier member 24 also formed of an easily destructable material such as foamed polystyrene is provided on each of the outer and inner side surfaces of the skirt with a notch 24*g* or 24*h* in the form of a semi-arch as best shown in FIG. 11. The groove 32' is of a U-shaped cross section but not of a C-shaped cross section and has the turned handrail 16*a* loosely disposed therein with a clearance maintained between the same and the surface of the handrail 16.

In other respects the arrangement is substantially similar to that shown in FIGS. 4 through 6.

Persons are frequently coming and going on that portion of the floor adjacent to the departure landing because those persons leaving the associated passenger conveyor walk not only straight there but also walk on the floor along either of the balustrades thereof after having turned in their walking direction. Under these circumstances, the provision of the semi-arch-shaped notch on either side of the barrier member is effective for preventing persons from undergoing a danger due to their stumbling over the barrier member and also for eliminating an objection that the barrier member will be broken for reasons other than those proper for the safety device, for example, the reason that any person strikes his or her footwear against the barrier member.

While the present invention has been illustrated and described in conjunction with a few preferred embodiments thereof it is to be understood that numerous changes and modifications may be resorted to without departing from the spirit and scope of the present invention. For example, the barrier member may be provided on either one of the side surfaces of the skirt with the semi-arch-shaped notch in accordance with a stream of people. Such a notch may be formed on either one or each of the inner and outer side surfaces of the skirt of the barrier member shown in each of FIGS. 6 through 8.

What we claim is:

1. In a passenger conveyor comprising a balustrade, a movable handrail traveling in use along the periphery of the balustrade and turned in its direction of travel at a conveyor departure landing, and a guide port for introducing the handrail into the mechanical portion of the passenger conveyor after it has been turned; a safety guard for the balustrade comprising: a barrier member disposed in front of said guide port and formed of a breakable material capable of easily being broken upon the application of a very low pressure by a conveyor passenger inadvertently applying pressure thereto and which produces a sound when breaking; and means defining an open groove on said barrier member, said groove having an opening narrower than the width of said movable handrail and having an inner portion dimensioned to receive said movable handrail, said movable handrail being disposed within the inner portion of said groove, and wherein said barrier member is formed of at least two barrier sections divided at a sectional plane extending lengthwise of the groove and intersecting the groove, said barrier sections being connected together in use into a unitary structure.

2. A safety guard as claimed in claim 1, wherein said sectional plane intersects the bottom surface of said groove and divides said barrier member vertically.

3. A safety guard as claimed in claim 1, wherein said sectional plane intersects an inner lateral surface of said groove and divides said barrier member horizontally.

4. In a passenger conveyor comprising a balustrade, a movable handrail traveling in use along the periphery of the balustrade and turned in the direction of travel thereof at a conveyor departure landing, and a guide port for introducing the handrail into the mechanical portion of the passenger conveyor after it has been turned; a safety guard for the balustrade comprising: a barrier member formed of a breakable material capable of being readily broken upon the application of a very low pressure by a conveyor passenger inadvertently applying pressure thereto and which produces a sound when breaking; said barrier member being disposed in front of said guide port and enclosed about the lateral surface of said moving handrail with a clearance maintained therebetween, and means defining a notch on at least one side surface portion thereof to reduce the width of the barrier member thereby to prevent conveyor passengers from striking against said barrier member.

* * * * *